US010584456B2

(12) United States Patent
Matsushita

(10) Patent No.: US 10,584,456 B2
(45) Date of Patent: Mar. 10, 2020

(54) PILE AND METHOD OF CARRYING OUT CONSTRUCTION BY MEANS OF THE SAME

(71) Applicant: Seiji Matsushita, Saga (JP)

(72) Inventor: Seiji Matsushita, Saga (JP)

(73) Assignee: Seiji Matsushita, Saga (JP)

( * ) Notice: Subject to any disclaimer, the term of this patent is extended or adjusted under 35 U.S.C. 154(b) by 0 days.

(21) Appl. No.: 16/282,641

(22) Filed: Feb. 22, 2019

(65) Prior Publication Data

US 2019/0271130 A1 Sep. 5, 2019

(30) Foreign Application Priority Data

Mar. 1, 2018 (JP) ..... 2018-036468

(51) Int. Cl.
*E02D 5/28* (2006.01)
*E02D 5/52* (2006.01)
*E02D 5/62* (2006.01)

(52) U.S. Cl.
CPC ..... *E02D 5/285* (2013.01); *E02D 5/523* (2013.01); *E02D 5/62* (2013.01); *E02D 2200/1685* (2013.01); *E02D 2250/003* (2013.01); *E02D 2300/0018* (2013.01); *E02D 2300/0029* (2013.01)

(58) Field of Classification Search
CPC ..... E02D 33/00; G01N 3/34
See application file for complete search history.

(56) References Cited

U.S. PATENT DOCUMENTS 1,794,892 A * 3/1931 Goldsborough ..... E02D 5/38 405/237
2,050,217 A * 8/1936 Watt ..... E02D 33/00 405/245
3,034,304 A * 5/1962 Upson ..... E02D 5/385 405/243
3,960,008 A * 6/1976 Goble ..... E02D 33/00 73/84
4,012,915 A * 3/1977 Poma ..... E02D 5/72 405/243
2006/0213279 A1* 9/2006 Choi ..... E02D 33/00 73/786

(Continued)

FOREIGN PATENT DOCUMENTS

GB 2072247 A * 9/1981 ..... E02D 33/00
JP 2006-291455 A 10/2006
WO WO-2006015278 A2 * 2/2006 ..... E02D 33/00

*Primary Examiner* — Tara Mayo-Pinnock
(74) *Attorney, Agent, or Firm* — Nakanishi IP Associates, LLC

(57) ABSTRACT

A pile to be inserted into a beforehand excavated hole, includes a main body being comprised of a hollow pipe, a circular bottom plate fixed at a lower end of the main body coaxially with the main body, a through-hole being formed therethrough outside of the main body, a hollow test pipe having an outer diameter such that the test pipe can be detachably inserted into the through-hole, and a cap being attached to a lower surface of the bottom plate so as to close the through-hole, S1:S2=W1:W2, wherein S1 indicates a surface area of the bottom plate, S2 indicates a surface area of the cap, W1 indicates a weight of a second drop hammer to fall in the main body, and W2 indicates a weight of the first drop hammer.

17 Claims, 7 Drawing Sheets

(56) References Cited

U.S. PATENT DOCUMENTS

| | | | | |
|---|---|---|---|---|
| 2007/0177948 | A1* | 8/2007 | Fedrick | E02D 5/32 405/228 |
| 2008/0141781 | A1* | 6/2008 | Hayes | G01M 99/007 73/788 |
| 2013/0011203 | A1* | 1/2013 | Reinhall | E02D 5/24 405/228 |
| 2016/0238498 | A1* | 8/2016 | Silva Carceles | G01N 3/307 |

* cited by examiner

PILE AND METHOD OF CARRYING OUT CONSTRUCTION BY MEANS OF THE SAME

This application is based upon and claims the benefit of priority from Japanese Patent Application No. 2018-036468 filed on Mar. 1, 2018, the entire disclosure of which, including specification, claims, drawings and summary, is incorporated herein by reference in its entirety.

BACKGROUND OF THE INVENTION

Field of the Invention

The invention relates to a pile to be used in various engineering and building works, and further to a method of carrying out construction by means of the pile.

Description of the Related Art

Japanese Patent Application Publication No. 2006-291455 has suggested an example of a method of carrying out construction by means of a pile.

FIG. 10 is a perspective view of the pile disclosed in the Publication, and FIG. 11 illustrates one of steps of a method of carrying out construction by means of the pile illustrated in FIG. 10.

As illustrated in FIG. 10, a pile 100 includes a hollow cylindrical main body 110 comprised of a steel pipe, a circular bottom plate 120 welded to a lower end of the main body 110, and a cross-shaped steel 130 welded onto a lower surface of the bottom plate 120.

The bottom plate 120 is designed to have an outer diameter slightly smaller than an outer diameter of a hole 140 (see FIG. 11) into which the pile 100 is to be inserted.

The pile 100 is used as follows.

First, as illustrated in FIG. 11, after the pile 100 was inserted into the hole 140, the bottom plate 120 is hit onto a bottom 141 of the hole 140 by means of a drop hammer (not illustrated) inserted into the main body 110 to thereby stably put the pile 100 on the bottom 141 of the hole 140.

Then, a space 150 formed between an outer surface of the main body 110 and an inner wall of the hole 140 is filled with excavated soil generated when the hole 140 was excavated. Thus, a resistance of the pile 100 against a stress and a tensile force is increased.

A stress-test to the pile 100 is carried out as follows. For instance, supposing that the bottom plate 120 has a diameter of 200 mm, a drop hammer having a weight of 15 tons is lifted up by about 1.5 meters above the bottom plate 120, and then, is caused to fall onto the bottom plate 120, resulting in heavy noise and oscillation problem. Thus, a stress-test to the pile 100 is sometimes not allowed to be carried out, and hence, a resistance to stress of the pile 100 cannot be measured.

SUMMARY OF THE INVENTION

It is an object of the present invention to provide a pile which enables to carry out a stress-test without occurrence of heavy noise and oscillation problem.

It is further an object of the present invention to provide a method of carrying out construction by means of the above-mentioned pile.

In an exemplary aspect of the present invention, there is provided a pile to be inserted into a beforehand excavated hole, including a main body comprised of a hollow pipe and having an outer diameter smaller than a diameter of the hole, a circular bottom plate fixed at a lower end of the main body coaxially with the main body, the bottom plate having an outer diameter greater than the outer diameter of the main body and insertable into the hole, a through-hole being formed therethrough outside of the main body, a hollow test pipe having such an inner diameter that a first drop hammer can fall therein, and having an outer diameter such that the test pipe can be detachably inserted into the through-hole, and a cap being attached to a lower surface of the bottom plate so as to close the through-hole, the cap being hit by the first drop hammer having fallen in the test pipe, $$S1:S2=W1:W2$$

wherein S1 indicates a surface area of the bottom plate, S2 indicates a surface area of the cap, W1 indicates a weight of a second drop hammer to fall in the main body, and W2 indicates a weight of the first drop hammer.

The pile may be designed to further include an auxiliary body comprised of a hollow pipe, the auxiliary body having an outer diameter insertable into the hole and being positioned around the main body coaxially with the main body above the bottom plate, and a plurality of supports extending radially of the main body from an outer surface of the main body, each of the supports being fixed at one end to the outer surface of the main body, and at the other end to an inner surface of the auxiliary body.

It is preferable that the bottom plate has an outer diameter equal to the same of the auxiliary body.

It is preferable that the auxiliary body has a length in the range of 20% to 70%, both inclusive, of a length of the main body in a length-wise direction of the pile.

It is preferable that an adhesive force with which the cap is attached to the bottom plate is equal to or smaller than an impact force generated when the first drop hammer hits the cap.

It is preferable that the test pipe has an outer diameter in the range of 15% to 35%, both inclusive, of the same of the main body.

It is preferable that the bottom plate is formed at a lower surface thereof with a recess, the cap being positioned in the recess, the recess having a depth equal to a height of the cap in a length-wise direction of the pile.

It is preferable that the main body has an outer diameter in the range of 50% to 70%, both inclusive, of the same of the bottom plate.

In another exemplary aspect of the present invention, there is provided a method of carrying out construction by means of a pile, including inserting a pile into a beforehand excavated hole, the pile including a main body being comprised of a hollow pipe and having an outer diameter smaller than a diameter of the hole, a circular bottom plate fixed at a lower end of the main body coaxially with the main body, the bottom plate having an outer diameter greater than the outer diameter of the main body and insertable into the hole, a through-hole being formed therethrough outside of the main body, a hollow test pipe having such an inner diameter that a first drop hammer can fall therein, and having an outer diameter such that the test pipe can be detachably inserted into the through-hole, and a cap being attached to a lower surface of the bottom plate so as to close the through-hole, the cap being hit by the first drop hammer having fallen in the test pipe, $$S1:S2=W1:W2$$

wherein S1 indicates a surface area of the bottom plate, S2 indicates a surface area of the cap, W1 indicates a weight of a second drop hammer to fall in the main body, and W2 indicates a weight of the first drop hammer, filling a space having been formed when the hole was excavated between an outer surface of the main body and an inner wall of the hole, with excavated soil and/or improved soil, lightly hitting the bottom plate to stably put the bottom plate on a bottom of the hole, filling an inner space of the main body with the excavated soil and/or the improved soil, and carrying out a stress-resistance test by causing the first drop hammer to fall in the test pipe.

The above and other objects and advantageous features of the present invention will be made apparent from the following description made with reference to the accompanying drawings, in which like reference characters designate the same or similar parts throughout the drawings.

DESCRIPTION OF THE EXEMPLARY EMBODIMENTS

Exemplary embodiments in accordance with the present invention will be explained hereinbelow with reference to drawings.

First Embodiment

Figure 1:
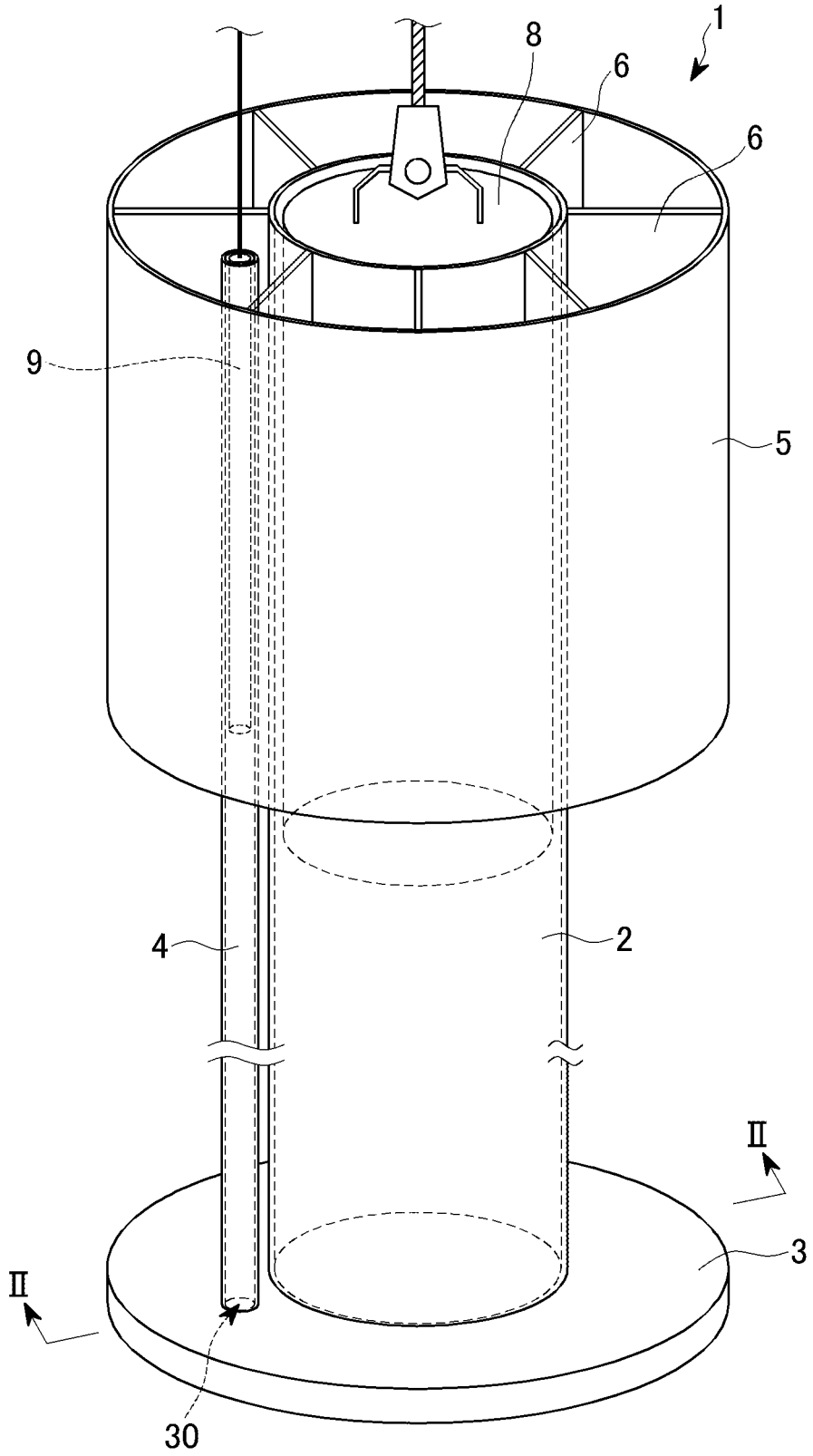
FIG. 1 is a perspective view of a pile in accordance with the first embodiment of the present invention.
Figure 2:
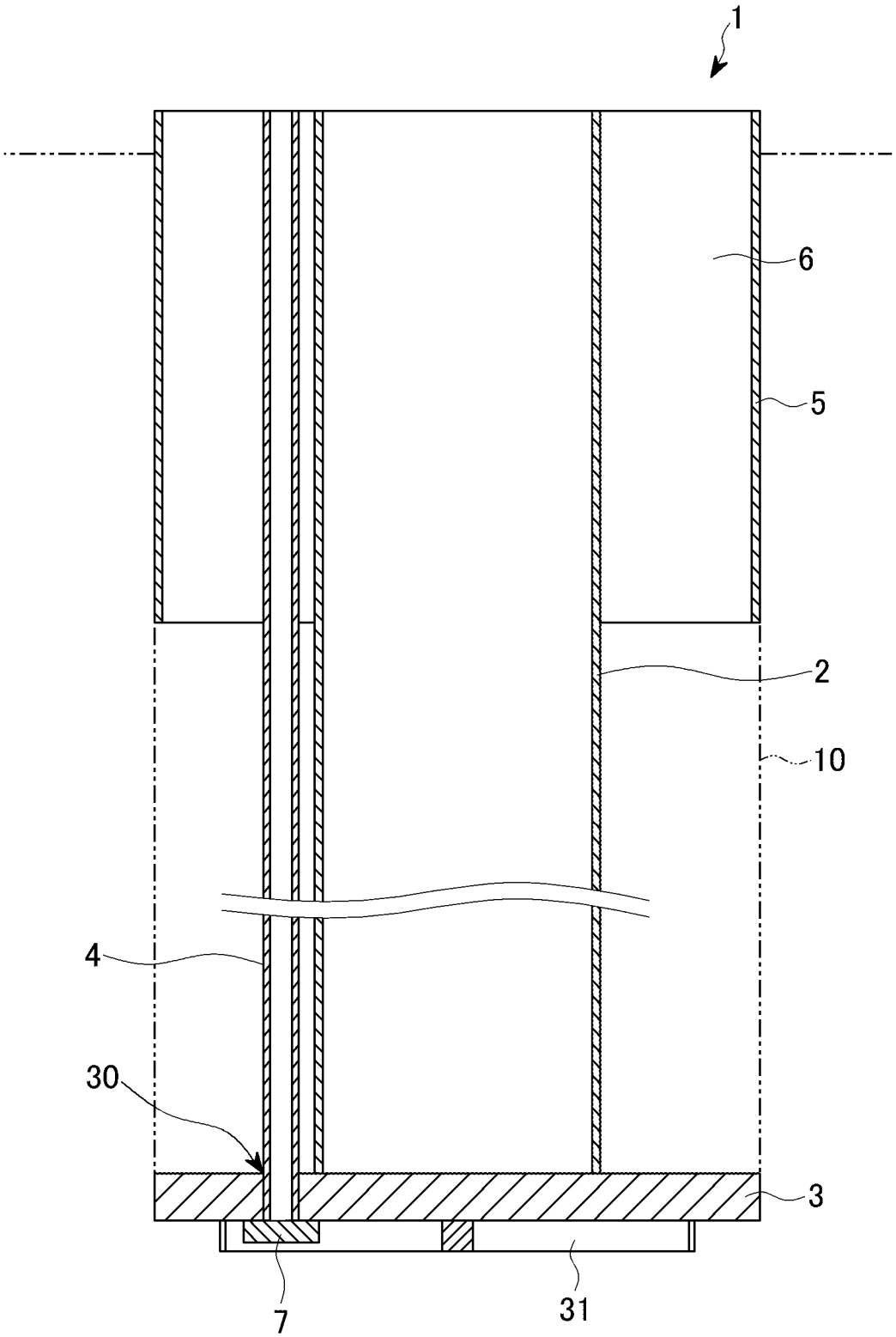
FIG. 2 is a cross-sectional view taken along the line II-II shown in FIG. 1.
Figure 3:
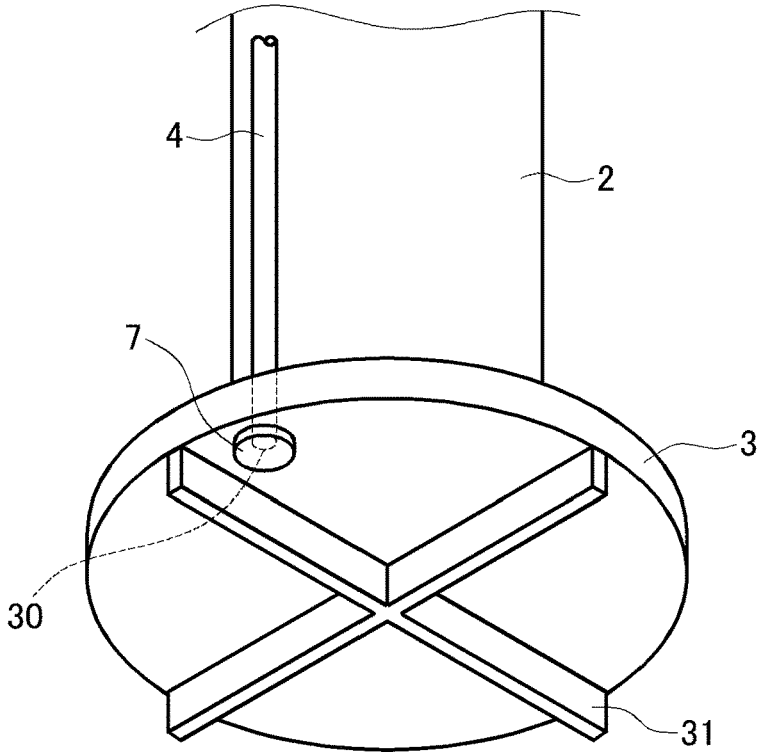
FIG. 3 is another perspective view of the pile illustrated in FIG. 1.

FIG. 1 is a perspective view of a pile in accordance with the first embodiment of the present invention, FIG. 2 is a cross-sectional view taken along the line II-II shown in FIG. 1, and FIG. 3 is a lower perspective view of the pile illustrated in FIG. 1.

As illustrated in FIGS. 1 to 3, the pile 1 in accordance with the firsts embodiment includes a main body 2 in the shape of a hollow cylinder, a bottom plate 3 in the shape of a circular plate, fixed at a lower end of the main body 2 coaxially with the main body 2, a hollow test pipe 4, and a cap 7 (see FIGS. 2 and 3).

The pile 1 is to be inserted into a hole 10 (see later-mentioned FIG. 4) having been excavated in advance.

The main body 2 has an outer diameter smaller than an inner diameter of the hole 10. For instance, the main body 2 is comprised of a steel pipe.

The bottom plate 3 has an outer diameter greater than an outer diameter of the main body 2 and insertable into the hole 10. Specifically, the bottom plate 3 has an outer diameter substantially equal to an inner diameter of the hole 10 or slightly smaller than an inner diameter of the hole 10.

For instance, the bottom plate 3 is comprised of a steel plate. The bottom plate 3 is formed with a through-hole 30 outside of the main body 2.

The test pipe 4 is designed to have an inner diameter to allow a drop hammer 9 to fall therein, and an outer diameter to allow the test pipe 4 to be detachably inserted into the through-hole 30. The test pipe 4 is inserted into the through-hole 30 such that a lower end thereof makes contact with the cap 7.

The cap 7 is attached to a lower surface of the bottom plate 3 to close the through-hole 30. Thus, the drop hammer 9 having fallen in the test pipe 4 hits the cap 7.

The cap 7 is comprised of a circular steel plate having a diameter of 400 mm, for instance.

The cap 7 is attached to a lower surface of the bottom plate 3 by means of an adhesive, or is welded to a lower surface of the bottom plate 3. An adhesive force with which the cap 7 is attached to a lower surface of the bottom plate 3 is no greater than an impact force generated when the drop hammer 9 hits the cap 7. That is, the adhesive force is equal to or smaller than the impact force. Accordingly, the cap 7 is sometimes taken off the bottom plate 3 when the drop hammer 9 hits the cap 7. It should be noted that there is no problem, even if the cap 7 is taken off the bottom plate 3, because the cap 7 has already landed on a bottom 10B (see FIG. 4) of the hole 10, and the stress test is completed at a moment when the drop hammer 9 has just hit the cap 7.

The bottom plate 3, the cap 7 and the drop hammer 9 are designed to meet with the following condition.

$$S1:S2=W1:W2$$

S1 indicates a surface area of the bottom plate 3, S2 indicates a surface area of the cap 7, W1 indicates a weight of a conventional drop hammer to fall in the main body 2, and W2 indicates a weight of the drop hammer 9.

That is, in the first embodiment, a ratio in a surface area between the cap 7 and the bottom plate 3 is designed to be equal to a ratio in a weight between the drop hammer 9 to be used in the first embodiment and a conventional drop hammer heavier than the drop hammer 9.

The main body 2 has an outer diameter smaller than an outer diameter of the hole 10. Specifically, the main body 2 is designed to have an outer diameter in the range of about 50% to about 75%, both inclusive, relative to an inner diameter of the hole 10, and preferably in the range of about 60% to about 65%, both inclusive, relative to an inner diameter of the hole 10. For instance, in the case that the hole 10 has an inner diameter of about 2000 mm, it is preferable that the main body 2 has an outer diameter in the range of about 1200 mm to about 1300 mm both inclusive.

The main body 2 is designed to have an outer diameter in the range of 50% to 70%, both inclusive, relative to an outer diameter of the bottom plate 3. For instance, in the case that the bottom plate 3 has an outer diameter of 4000 mm, the main body 2 is designed to have an outer diameter in the range of 2000 mm to 2800 mm both inclusive.

The test pipe 4 is designed to have an outer diameter in the range of 15% to 35% both inclusive relative to an outer diameter of the main body 2. For instance, in the case that the main body 2 has an outer diameter of 2000 mm, the test pipe 4 is designed to have an outer diameter in the range of 300 mm to 700 mm both inclusive.

The pile 1 in accordance with the first embodiment further includes a hollow cylindrical auxiliary body 5 positioned around the main body 2 above the bottom plate 2, and a plurality of (specifically, "eight" in the first embodiment) supports 6 each extending radially of the main body 2 from an outer surface of the main body 2.

The auxiliary body 5 is positioned coaxially of the main body 2, and is supported to the main body 2 by means of the supports 6. Specifically, each of the supports 6 is fixed (for instance, welded) at one end to an outer surface of the main body 2, and at the other end to an inner surface of the auxiliary body 5. The supports 6 each is comprised of a flat steel plate, for instance.

The auxiliary body 5 is designed to have an outer diameter equal to an outer diameter of the bottom plate 3.

The auxiliary body 5 downwardly extends from an upper end of the main body 2, and is designed to have a length in the range of 20% to 70%, both inclusive, relative to a length of the main body 2 in a length-wise direction of the pile 1. For instance, in the case that the main body 2 has a length of 8000 mm, the auxiliary body 5 is designed to have a length in the range of 1600 mm to 5600 mm both inclusive in a length-wise direction of the pile 1.

Though the pile 1 in accordance with the first embodiment is designed to include the auxiliary body 5 and the supports 6, it should be noted that the pile 1 may be designed to not include those, if necessary.

A cross-shaped steel 31 is welded onto a lower surface of the bottom plate 3 in order to allow the pile 1 to be able to stably stand on a bottom of the hole 10.

FIGS. 4 to 8 are cross-sectional views each showing a step in a method of carrying out construction by means of the pile 1.

Figure 4:
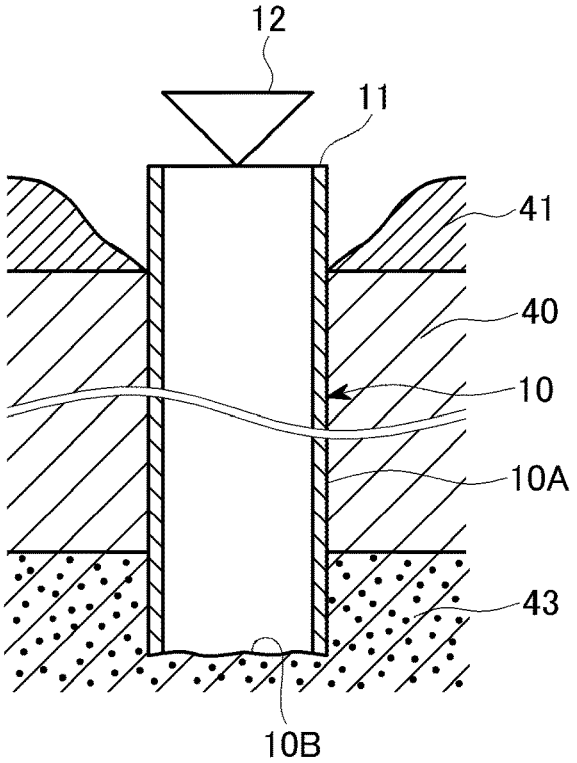
FIG. 4 illustrates one of steps included in a method of carrying out construction by means of the pile illustrated in FIG. 1.

FIG. 4 illustrates a step of digging the hole 10 by so-called all casing process, before the pile 1 is used.

As illustrated in FIG. 4, a casing 11 is pushed into a ground 40 with the casing 11 being oscillated, and further with bentonite (not illustrated) being introduced into the ground 40 in order to solidify an inner wall 10A of the hole 10. While the hole 10 is being excavated, excavated soil 41 is taken off out of the casing 11. The excavated soil 41 is mixed with quicklime and cement to produce improved soil 42 (see FIG. 6). As mentioned later, the hole 10 is filled with improved soil 42 after the pile 1 has been inserted into the hole 10.

After the casing reached a support layer 43 at a lower end thereof, a deposition bucket 12 is caused to lower in the casing 11 until it reaches a bottom 10B of the hole 10. After slime was precipitated in the deposition bucket 12, the casing 11 and the deposition bucket 12 are lifted up off the hole 10. Thus, there is completed the hole 10 having an inner diameter of 2000 mm.

Figure 5:
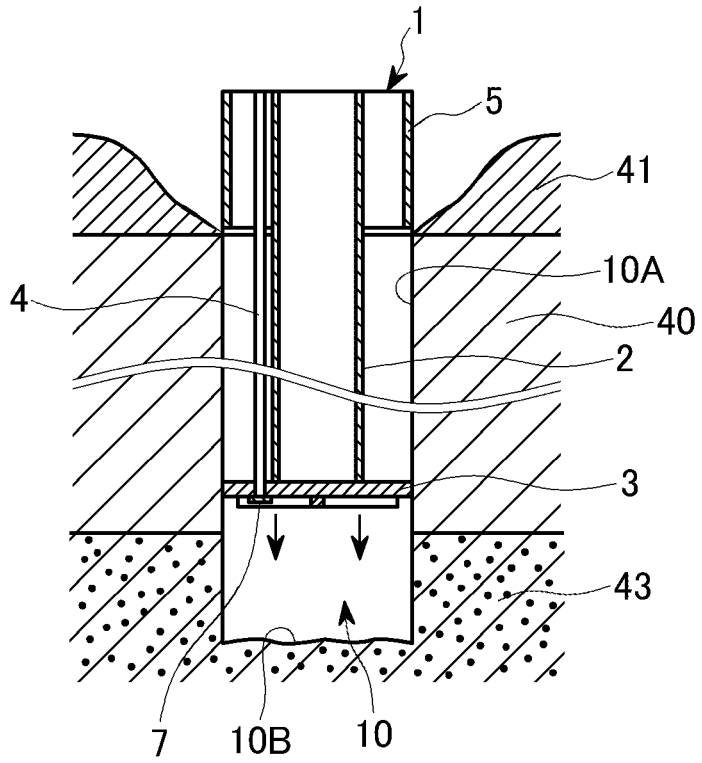
FIG. 5 illustrates one of steps included in a method of carrying out construction by means of the pile illustrated in FIG. 1.

FIG. 5 illustrates a step of inserting the pile 1 into the hole 10.

The pile 1 being hung by a crawler crane (not illustrated) lowers in the hole 10 until the bottom plate 3 reaches the bottom 10B of the hole 10.

Figure 6:
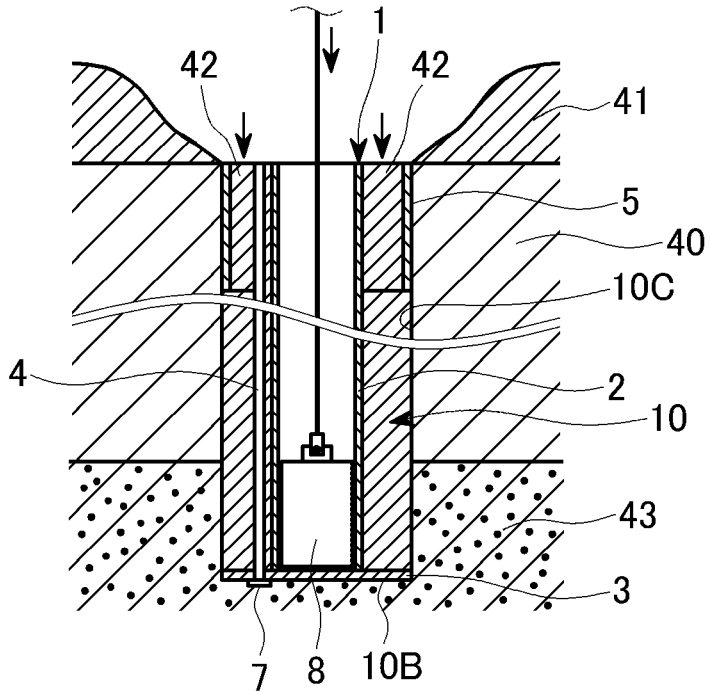
FIG. 6 illustrates one of steps included in a method of carrying out construction by means of the pile illustrated in FIG. 1.

Then, as illustrated in FIG. 6, a space formed between an outer surface of the main body 2 and an inner wall 10C of the hole 10 is filled with the improved soil 42. Since the auxiliary body 5 surrounding an upper portion of the main body 2 allows the upper portion of the main body 2 having an outer diameter smaller than an inner diameter of the hole 10 to be supported by the inner wall 10C of the hole 10, it is possible to avoid the pile 1 from falling down while the hole 10 is being filled with the improved soil 42.

Then, as illustrated in FIG. 6, the bottom plate 3 is lightly hit onto the bottom 10B of the hole 10 by means of a drop hammer 8 having fallen in the main body 2 to thereby stably put the bottom plate 3 on the bottom 10B of the hole 10.

Figure 7:
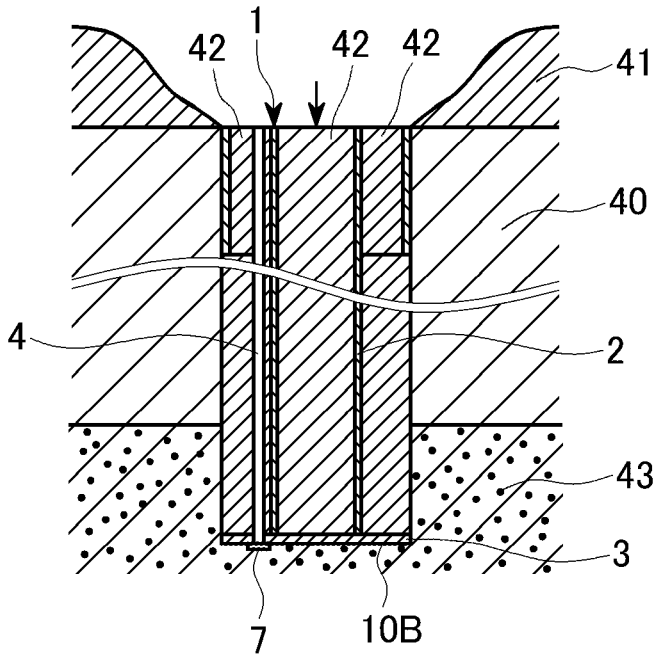
FIG. 7 illustrates one of steps included in a method of carrying out construction by means of the pile illustrated in FIG. 1.

Then, as illustrated in FIG. 7, the main body 2 is filled with the improved soil 42. The improved soil 42 expands about 1.5 times to about 2 times in a volume. Thus, not only the improved soil 42 filling the inside of the main body 2, but also the improved soil 42 existing around the main body 2 expands to be compacted, resulting in that the pile 1 can act as a quiet firm pile. Thus, whereas the bottom plate 3 has an outer diameter of 2000 mm (this is because the hole 10 has an inner diameter of 2000 mm), the main body 2 is designed to have an outer diameter in the range of 50% to 70%, both inclusive, relative to an outer diameter of the bottom plate 3. For instance, it is most preferable that the main body 2 has an outer diameter equal to about 60% of an outer diameter of the bottom plate 3.

Figure 8:
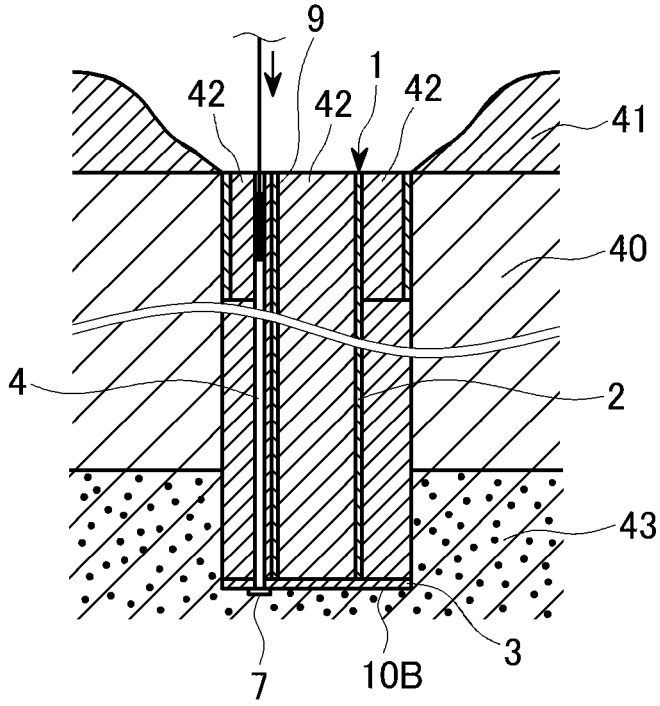
FIG. 8 illustrates one of steps included in a method of carrying out construction by means of the pile illustrated in FIG. 1.

Then, as illustrated in FIG. 8, the drop hammer 9 is inserted into the test pipe 4, and allows to fall in the test pipe 4. The drop hammer 9 hits the cap 7 attached to a lower surface of the bottom plate 3 to thereby carry out the stress test.

As mentioned earlier, a relation among a surface area of the bottom plate 3, a surface area of the cap 7, and a weight of the drop hammer 9 is determined to meet with the following ratio.

$$S1:S2=W1:W2$$

S1 indicates a surface area of the bottom plate 3, S2 indicates a surface area of the cap 7, W1 indicates a weight of a conventional drop hammer to fall in the main body 2, and W2 indicates a weight of the drop hammer 9.

As mentioned above, the bottom plate 3 has an outer diameter of 2000 mm, and the cap 7 has an outer diameter of 400 mm in the first embodiment, a ratio in a surface area between the bottom plate 3 and the cap 7 is calculated as follows.

$$S1:S2=2000^2:400^2=25:1$$

Accordingly, the drop hammer 9 is designed to have a weight W2 equal to 1/25 of a weight W1 of the conventional drop hammer (which is identical with the drop hammer 8 illustrated in FIG. 6).

Thus, the pile 1 in accordance with the first embodiment makes it possible to carry out a stress test by means of the drop hammer 9 having a weight equal to 1/25 of a weight of the conventional drop hammer.

Since a ratio in a surface area between the cap 7 and the bottom plate 3 is set equal to a ratio in a weight between the drop hammer 9 and a conventional drop hammer heavier than the drop hammer 9, it is possible to carry out a stress test even by means of the drop hammer 9 lighter than a conventional drop hammer.

Thus, the pile 1 in accordance with the first embodiment makes it possible to remarkably reduce impact generated when the drop hammer 9 hits the bottom plate 3 in comparison with impact generated in a conventional stress test, ensuring remarkable reduction of noise and oscillation.

After the stress test was over, the test pipe 4 is pulled out of the through-hole 30. A space in which the test pipe 4 used to exist is filled with the improved soil 42.

Though the bottom plate 3 and the cap 7 are both designed to be in the shape of a circle in the first embodiment, it should be noted that shapes of them are not to be limited to a circle, and they may have any shape. The bottom plate 3 may have any shape, if insertable into the hole 10. The cap 7 may have any shape other than a circle. Furthermore, it is not always necessary that both the bottom plate 3 and the cap 7 are circular in shape. For instance, the bottom plate 3 may be circular, and the cap 7 may be rectangular.

Second Embodiment

Figure 9:
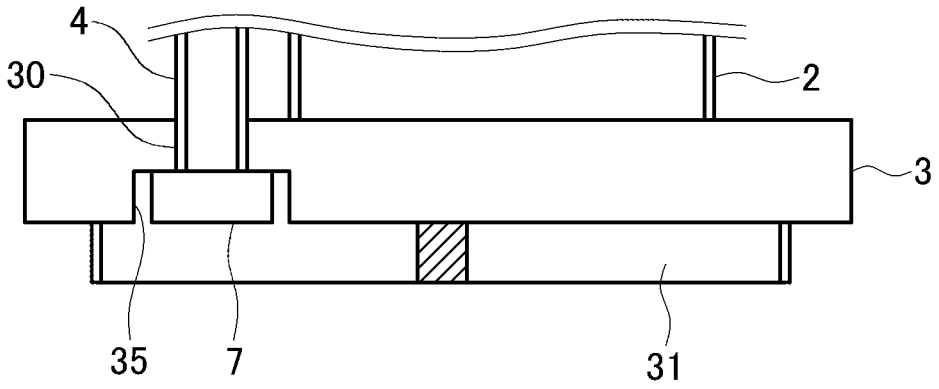
FIG. 9 is a partial cross-sectional view of a pile in accordance with the second embodiment of the present invention.
Figure 10:
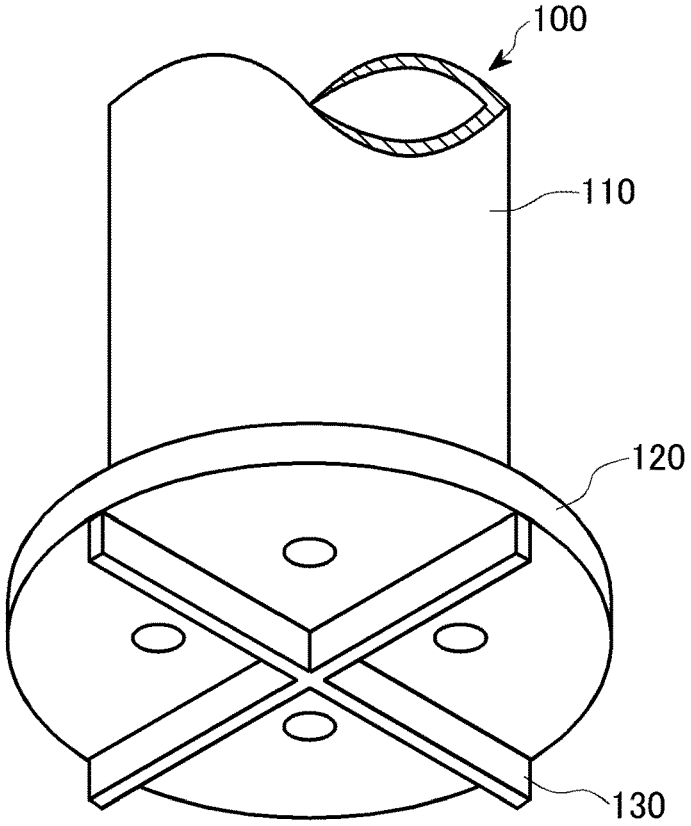
FIG. 10 PRIOR ART
FIG. 10 is a partial perspective view of the conventional pile.
Figure 11:
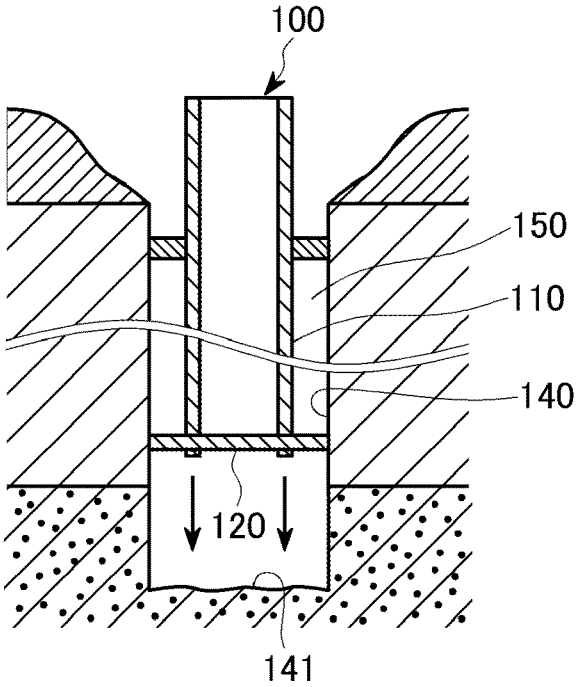
FIG. 11 PRIOR ART
FIG. 11 illustrates one of steps included in a method of carrying out construction by means of the conventional pile illustrated in FIG. 10.

FIG. 9 is a partial cross-sectional view of a pile in accordance with the second embodiment of the present invention.

As illustrated in FIG. 9, the bottom plate 3 in the second embodiment is formed at a lower surface thereof with a recess 35 having a circular cross-section. The pile in accordance with the second embodiment is identical in structure with the pile 1 in accordance with the first embodiment except the recess 35.

The cap 7 in the second embodiment is positioned in the recess 35. The recess 35 is designed to a depth equal to a height of the cap 7 in a length-wise direction of the pile. Thus, a lower surface of the cap 7 and a lower surface of the bottom plate 3 are in the same horizontal level or in a common horizontal plane.

Since a lower surface of the cap 7 and a lower surface of the bottom plate 3 are in a common horizontal plane, when a lower surface of the bottom plate 3 lands on the bottom 10B of the hole 10, a lower surface of the cap 7 simultaneously lands on the bottom 10B of the hole 10. Accordingly, a stress test carried out by causing the drop hammer 9 to hit the cap 7 can be carried out in the same condition as a stress test carried out by causing a conventional heavy drop hammer to hit the bottom plate 3.

The exemplary advantages obtained by the above-mentioned exemplary embodiments are described hereinbelow.

In the above-mentioned embodiments, the stress test is carried out by allowing the drop hammer 9 lighter than a conventional drop hammer to fall in the test pipe 4 and to hit the cap 7 attached on a lower surface of the bottom plate 3, without hitting the bottom plate 3 with the conventional heavy drop hammer. In the piles in accordance with the above-mentioned first and second embodiments, a ratio between a weight of the drop hammer 9 and a surface area of the cap 7 is set equal to a ratio between a weight of the conventional heavy drop hammer and a surface area of the bottom plate 120. In other words, a ratio in a surface area between the cap 7 and the bottom plate 3 is set equal to a ratio in a weight between the drop hammer 9 and the conventional drop hammer heavier than the drop hammer 9.

Thus, it is possible to carry out a stress test even by means of the drop hammer 9 lighter than a conventional drop hammer. Since the drop hammer 9 to be employed in the above-mentioned embodiments is lighter than the conventional drop hammer, impact to the cap 7 can be reduced, resulting in that the stress test can be carried out with noise and oscillation being significantly reduced.

In addition, the auxiliary body 5 enables the main body 2 having an outer diameter smaller than an inner diameter of the hole 10 to make contact at an upper portion thereof with an inner wall of the hole 10, and hence, it is possible to prevent the pile from falling down while a space formed between an outer surface of the main body 2 and an inner wall of the hole 10 is being filled with the excavated and/or improved soil.

Industrial Applicability

The present invention is useful for a pile and a method of carrying out construction through the use of a pile. Specifically, the present invention makes it possible to carry out a stress test with noise and oscillation being significantly reduced.

While the present invention has been described in connection with certain exemplary embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A pile and a beforehand excavated hole, wherein the pile is configured to be inserted into the beforehand excavated hole, the pile including:

a main body being comprised of a hollow pipe and having an outer diameter smaller than a diameter of the hole;

a circular bottom plate fixed at a lower end of the main body coaxially with the main body, the bottom plate having an outer diameter greater than the outer diameter of the main body and insertable into the hole, a through-hole being formed therethrough outside of the main body;

a hollow test pipe having such an inner diameter that a first drop hammer can fall therein, and having an outer diameter such that the test pipe can be detachably inserted into the through-hole; and a cap being attached to a lower surface of the bottom plate so as to close the through-hole, the cap being hit by the first drop hammer having fallen in the test pipe, $$S1:S2=W1:W2$$

wherein

S1 indicates a surface area of the bottom plate,

S2 indicates a surface area of the cap,

W1 indicates a weight of a second drop hammer to fall in the main body, and

W2 indicates a weight of the first drop hammer.

2. The pile as set forth in claim 1, wherein the test pipe has an outer diameter in the range of 15% to 35%, both inclusive, of the same of the main body.

3. The pile as set forth in claim 1, wherein the bottom plate is formed at a lower surface thereof with a recess, the cap being positioned in the recess, the recess having a depth equal to a height of the cap in a length-wise direction of the pile.

4. The pile as set forth in claim 1, further including:

an auxiliary body comprised of a hollow pipe, the auxiliary body having an outer diameter insertable into the hole and being positioned around the main body coaxially with the main body above the bottom plate; and a plurality of supports extending radially of the main body from an outer surface of the main body, each of the supports being fixed at one end to the outer surface of the main body, and at the other end to an inner surface of the auxiliary body.

5. The pile as set forth in claim 4, wherein the bottom plate has an outer diameter equal to the same of the auxiliary body.

6. The pile as set forth in claim 4, wherein the auxiliary body has a length in the range of 20% to 70%, both inclusive, of a length of the main body in a length-wise direction of the pile.

7. The pile as set forth in claim 1, wherein an adhesive force with which the cap is attached to the bottom plate is equal to or smaller than an impact force generated when the first drop hammer hits the cap.

8. The pile as set forth in claim 1, wherein the main body has an outer diameter in the range of 50% to 70%, both inclusive, of the same of the bottom plate.

9. A method of carrying out construction by means of a pile, including:

inserting a pile into a beforehand excavated hole, the pile including:

a main body being comprised of a hollow pipe and having an outer diameter smaller than a diameter of the hole;

a circular bottom plate fixed at a lower end of the main body coaxially with the main body, the bottom plate having an outer diameter greater than the outer diameter of the main body and insertable into the hole, a through-hole being formed therethrough outside of the main body;

a hollow test pipe having such an inner diameter that a first drop hammer can fall therein, and having an outer diameter such that the test pipe can be detachably inserted into the through-hole; and a cap being attached to a lower surface of the bottom plate so as to close the through-hole, the cap being hit by the first drop hammer having fallen in the test pipe, $$S1:S2=W1:W2$$

wherein

S1 indicates a surface area of the bottom plate,

S2 indicates a surface area of the cap,

W1 indicates a weight of a second drop hammer to fall in the main body, and

W2 indicates a weight of the first drop hammer;

filling a space having been formed when the hole was excavated between an outer surface of the main body and an inner wall of the hole, with excavated soil;

hitting the bottom plate to stably put the bottom plate on a bottom of the hole;

filling an inner space of the main body with the excavated soil; and carrying out a stress-resistance test by causing the first drop hammer to fall in the test pipe.

10. A pile to be inserted into a beforehand excavated hole, including:

a main body being comprised of a hollow pipe;

a circular bottom plate fixed at a lower end of the main body coaxially with the main body, the bottom plate having an outer diameter greater than the outer diameter of the main body and insertable into the hole, a through-hole being formed therethrough outside of the main body;

a hollow test pipe having such an inner diameter that a first drop hammer can fall therein, and having an outer diameter such that the test pipe can be detachably inserted into the through-hole; and a cap being attached to a lower surface of the bottom plate so as to close the through-hole, the cap being hit by the first drop hammer having fallen in the test pipe, $$S1:S2=W1:W2$$

wherein

S1 indicates a surface area of the bottom plate,

S2 indicates a surface area of the cap,

W1 indicates a weight of a second drop hammer to fall in the main body, and

W2 indicates a weight of the first drop hammer.

11. The pile as set forth in claim 10, further including:

an auxiliary body comprised of a hollow pipe, the auxiliary body having an outer diameter insertable into the hole and being positioned around the main body coaxially with the main body above the bottom plate; and a plurality of supports extending radially of the main body from an outer surface of the main body, each of the supports being fixed at one end to the outer surface of the main body, and at the other end to an inner surface of the auxiliary body.

12. The pile as set forth in claim 11, wherein the auxiliary body has a length in the range of 20% to 70%, both inclusive, of a length of the main body in a length-wise direction of the pile.

13. The pile as set forth in claim 10, wherein an adhesive force with which the cap is attached to the bottom plate is equal to or smaller than an impact force generated when the first drop hammer hits the cap.

14. The pile as set forth in claim 10, wherein the test pipe has an outer diameter in the range of 15% to 35%, both inclusive, of the same of the main body.

15. The pile as set forth in claim 10, wherein the bottom plate is formed at a lower surface thereof with a recess, the cap being positioned in the recess, the recess having a depth equal to a height of the cap in a length-wise direction of the pile.

16. The pile as set forth in claim 10, wherein the main body has an outer diameter in the range of 50% to 70%, both inclusive, of the same of the bottom plate.

17. The pile as set forth in claim 11, wherein the bottom plate has an outer diameter equal to the same of the auxiliary body.

* * * * *